US005564821A

United States Patent [19]

Hesprich

[11] Patent Number: 5,564,821

[45] Date of Patent: Oct. 15, 1996

[54] SHOCK ABSORBING BULB SOCKET FOR HAND-HELD LIGHT

[75] Inventor: Donald N. Hesprich, Charlotte, N.C.

[73] Assignee: Jameson Corporation, Charlotte, N.C.

[21] Appl. No.: 425,395

[22] Filed: Apr. 21, 1995

Related U.S. Application Data

[62] Division of Ser. No. 285,417, Aug. 3, 1994, abandoned.

[51] Int. Cl.[6] ..... F21V 15/00

[52] U.S. Cl. ..... 362/378; 362/260; 362/399; 439/382

[58] Field of Search ..... 362/223, 306, 362/390, 399, 260, 216, 378; 313/50; 439/382, 384

[56] References Cited

U.S. PATENT DOCUMENTS

| | | | |
|---|---|---|---|
| 4,092,706 | 5/1978 | Vest | 362/390 |
| 4,486,689 | 12/1984 | Davis et al. | 315/92 |
| 4,885,670 | 12/1989 | Baake | 362/390 X |
| 4,945,461 | 7/1990 | Crates | 362/378 |
| 5,117,345 | 5/1992 | Baake | 362/400 X |
| 5,170,332 | 12/1992 | Browne | 362/399 X |

*Primary Examiner*—Stephen F. Husar
*Attorney, Agent, or Firm*—W. Thad Adams, III

[57] ABSTRACT

A hand-held fluorescent light includes a handle to be gripped by the user for carring the light. An electronic ballast is contained in the handle for providing starting voltage and for limiting electric current through the circuit elements of the light. A replaceable, phosphor-coated, sealed bulb is connected to the handle and includes at least one electrode located in the bulb for receiving an electric current from the ballast. A shock absorbing bulb socket serves to electrically connect the electrode and the ballast together.

10 Claims, 9 Drawing Sheets

SHOCK ABSORBING BULB SOCKET FOR HAND-HELD LIGHT

TECHNICAL FIELD AND BACKGROUND OF THE INVENTION

This application is a divisional of application Ser. No. 08/285,417, filed on Aug. 3, 1994, now abandoned.

This invention relates to a hand-held fluorescent light. The invention is portable, and especially designed for high illumination in tight work spaces. The invention is particularly useful in home garages, automobile shops, constructions sites, industrial plants, and other similar environments.

Typical work lights of the prior art suffer from many drawbacks and disadvantages. Some of these problems relate specifically to the type of ballast used to activate the fluorescent bulb. Magnetic ballasts have been commonly used in the past. This type of ballast generally requires between 2–5 seconds of activation time, thus producing an annoying flicker prior to achieving full brightness. Magnetic ballasts are relatively large and heavy, and produce a relatively loud noise during use. Furthermore, magnetic ballasts typically utilize a starter in conjunction with the ballast to induce a high voltage spike that will excite the gas inside the fluorescent bulb. Voltage variations and droppage will often cause the light to go out, thus requiring the starter and ballast to reactivate the fluorescent bulb. This can take anywhere from 2–8 seconds, causing a dangerous condition if there is only one light used for illumination.

Some portable lights utilize an electronic ballast. According to one prior art light, an electronic ballast is located in a protective shield surrounding the fluorescent bulb. This light includes a relatively low-voltage DC circuit with a DC/AC inverter to create the high-voltage AC current necessary to light the fluorescent tube. The ballast is difficult to access and replace. In addition, because the electrical components of the ballast are exposed when the protective shield is removed, the prior art light creates a potentially hazardous situation to the user when re-lamping or repairing the light.

The present invention overcomes these and other problems of the prior art by providing a fluorescent work light with an electronic ballast completely contained within the handle of the light. The ballast is encapsulated in a non-conductive housing which is easily and safely removed and replaced. The invention is virtually flicker-free, quiet during use, energy efficient, relatively small and light, and instantly activated to provide high illuminating light.

Additional problems of prior art work lights relate to impact resistance and cold temperature starting. Generally, when a light is dropped one or more times at relatively low heights, the bulb breaks and requires replacement. The shattered bulb is difficult to remove from the connecting socket, and may cause serious injury to the user.

The work light of the present invention includes protective features for absorbing sudden impacts which in the past have caused the fluorescent bulb to fracture or shatter. During testing, the present work light was subjected to cold temperatures, beating, and dropping. At 5° F. for 96 hours, the work light started at low brightness. At 13° F. for 15 hours, the work light started at low brightness, but came to full brightness within 5 minutes.

The durability of light was tested by gripping the handle and beating the tip of the light up to 4000 times. The glass bulb was not damaged. The tip of the light was then gripped, and the light was handle-beaten up to 5000 times, again without damaging the glass bulb.

In addition, the work light was dropped on end (tip dropped), handle dropped, and thrown to further test the impact resistive features of the light. In one test, the light was randomly dropped at 12 feet. No weak spots or fractures were found in the glass bulb. In another test, the work light tip-dropped at 12 ft. rebounded approximately 6–7 ft. This means that only about 25–30% of the impacting force applied to the light was absorbed by the light. Of this 25–30%, about 80% of the energy was absorbed by the protective bulb shield surrounding the bulb. Thus, only about 15% of the drop actually impacted upon the bulb. For example, a 12 ft. tip-drop of the present light is generally equivalent to an 8 inch drop of a bare bulb onto a concrete surface.

SUMMARY OF THE INVENTION

Therefore, it is an object of the invention to provide a fluorescent work light which includes an electronic ballast contained in the handle of the light.

It is another object of the invention to provide a work light which includes a ballast completely encapsulated in a removable housing which is non-conductive and waterproof.

It is another object of the invention to provide a work light including a ballast which has no exposed electrical components.

It is another object of the invention to provide a work light which will not go out as a result of sudden voltage drops or variations.

It is another object of the invention to provide a work light which is portable.

It is another object of the invention to provide a work light which is relatively light weight.

It is another object of the invention to provide a work light which can be used with a standard 120 V AC electrical circuit.

It is another object of the invention to provide a work light which is relatively quiet during use.

It is another object of the invention to provide a work light which is virtually flicker-free.

It is another object of the invention to provide a work light which is energy efficient.

It is another object of the invention to provide a work light which is instantly activated to provide high intensity illumination.

It is another object of the invention to provide a work light which includes non-conductive surfaces.

It is another object of the invention to provide a work light which can be re-lamped safely without significant risk of injury to the user.

It is another object of the invention to provide a work light which can be easily re-lamped without the use of tools.

It is another object of the invention to provide a work light with impact-resisting features for protecting the bulb from breakage when the light is dropped.

It is another object of the invention to provide a work light which includes replaceable elements which are easily assembled and disassembled.

These and other objects of the present invention are achieved in the preferred embodiments disclosed below by providing a hand-held fluorescent light. The light includes a handle to be gripped by the user for carrying the light. An electronic ballast is contained in the handle for providing starting voltage and for limiting electric current through the circuit elements of the light. A replaceable, phosphor-coated, sealed bulb is connected to the handle and includes at least one electrode located in the bulb for receiving an electric current from the ballast. Connecting means serves to electrically connect the electrode and the ballast together.

According to one preferred embodiment of the invention, the ballast is encapsulated in a cylindrical housing and removably disposed within the handle of the light.

According to another preferred embodiment of the invention, the ballast is an instant-start circuit.

According to yet another preferred embodiment of the invention, a light-transmitting, protective bulb shield surrounds the bulb to protect the bulb from damage during use of the light.

According to yet another preferred embodiment of the invention, the bulb shield is tubular and extends outwardly from the handle. The bulb shield has first and second ends, and the first end is attached to the handle.

According to yet another preferred embodiment of the invention, the connecting means is a shock-absorbing bulb socket interposed between the ballast and the bulb. The socket engages the inner wall of the bulb shield at the first end thereof for protecting the bulb from impact damage.

According to yet another preferred embodiment of the invention, the bulb socket includes a plurality of longitudinal openings for receiving therein a plurality of electrical wires associated with the ballast and a corresponding number of outwardly-extending external pins associated with the at least one electrode.

According to yet another preferred embodiment of the invention, the bulb socket includes an inwardly tapered guide recess for guiding the electrode pins of the bulb into the respective openings of the socket for engagement with the electrical wires of the ballast.

According to yet another preferred embodiment of the invention, the bulb socket includes an annular flange located adjacent to an annular peripheral edge of the first end of the bulb shield for providing shock absorption to protect the bulb from impact damage.

According to yet another preferred embodiment of the invention, a shock-absorbing plug is located at the second end of the bulb shield. The plug engages on one side thereof the free end of the bulb to protect the bulb from impact damage.

According to yet another preferred embodiment of the invention, the plug includes an annular flange located adjacent to an annular peripheral edge of the second end of the bulb shield for providing shock absorption to protect the bulb from impact damage.

According to yet another preferred embodiment of the invention, a removable, shock-absorbing end cap is located on the second end of the bulb shield for covering the second end of the bulb shield.

According to yet another preferred embodiment of the invention, a pull strip is releasably attached to the bulb for removing the bulb from the socket and bulb shield for replacement. The pull strip has first and second ends. The first end is attached to a proximal end of the bulb, and the second end extends beyond the second end of the bulb shield for access to the user. The bulb is removed from the socket and bulb shield by gripping the second end of the pull strip and gently pulling outwardly to release the bulb from the socket.

According to yet another preferred embodiment of the invention, the pull strip includes at least one pin opening located at the first end of the pull strip for being releasably attached to at least one outwardly-extending external pin associated with the electrode at the proximal end of the bulb.

Preferably, the pull strip is formed of a non-conductive, chrome-finished polymer material.

According to another preferred embodiment of the invention, the bulb includes a pin base, and a U-shaped bulb tube extending outwardly from the pin base.

According to yet another preferred embodiment of the invention, the U-shaped bulb tube includes first and second electrodes connected to the pin base. The electrodes have respective outwardly-extending external pins associated therewith for being electrically connected to the ballast.

According to yet another preferred embodiment of the invention, a hanger hook is connected to the light for hanging the light from a supporting structure.

BRIEF DESCRIPTION OF THE DRAWINGS

Some of the objects of the invention have been set forth above. Other objects and advantages of the invention will appear as the invention proceeds when taken in conjunction with the following drawings, in which.

DESCRIPTION OF THE PREFERRED EMBODIMENT AND BEST MODE

Figure 1:
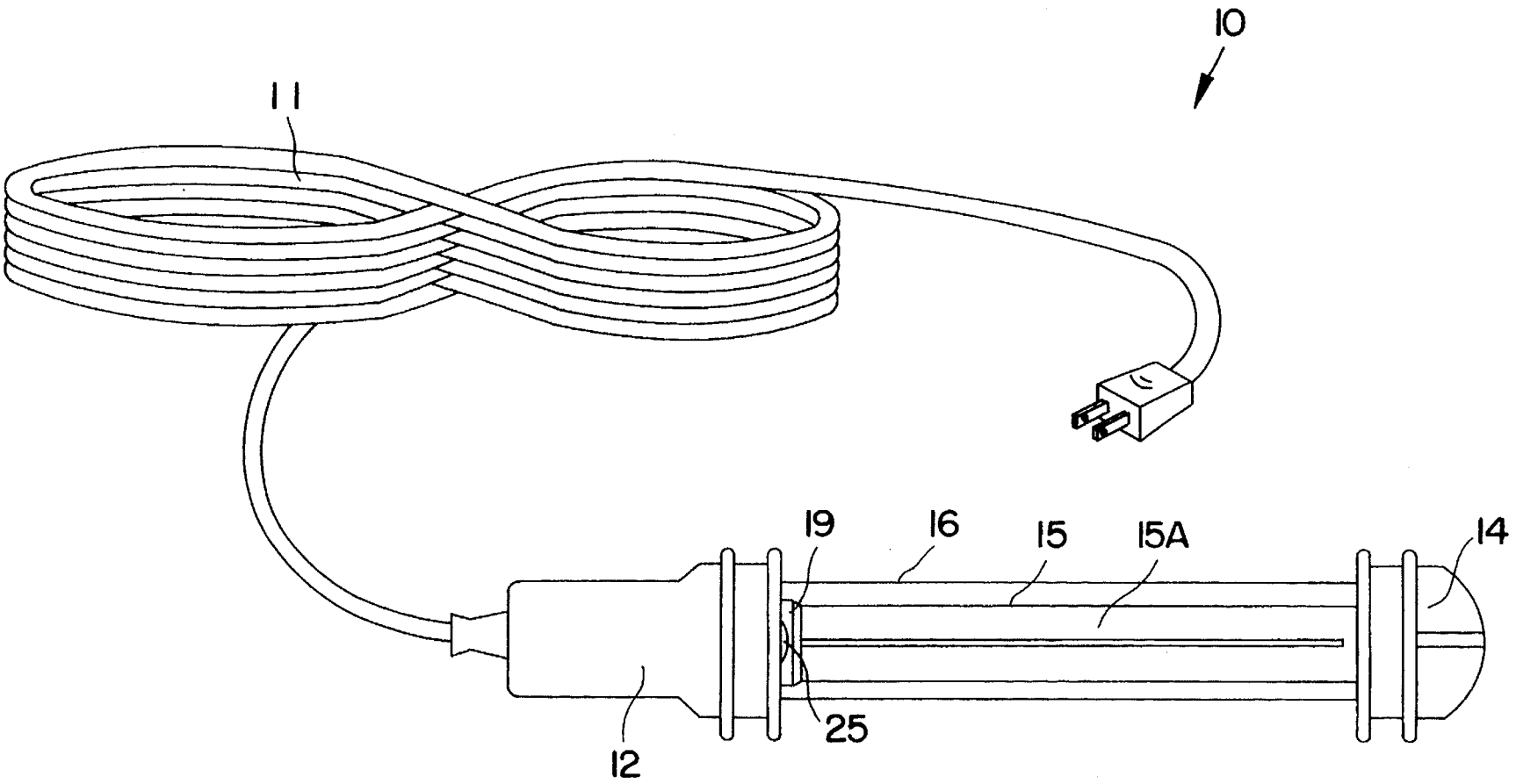
FIG. 1 is a perspective view of the work light according to one preferred embodiment of the invention.

Referring now specifically to the drawings, a hand-held fluorescent work light according to the present invention is illustrated in FIG. 1 and shown generally at reference numeral 10. The work light 10 is particularly useful in home garages, automobile shops, constructions sites, industrial plants, and other similar environments where work space is limited and the use of a powerful, hand-held light is desirable. Preferably, the work light weighs between 2 and 8 lbs. with various lengths ranging from between 10 and 25 inches (25 and 64 cm).

Figure 2:
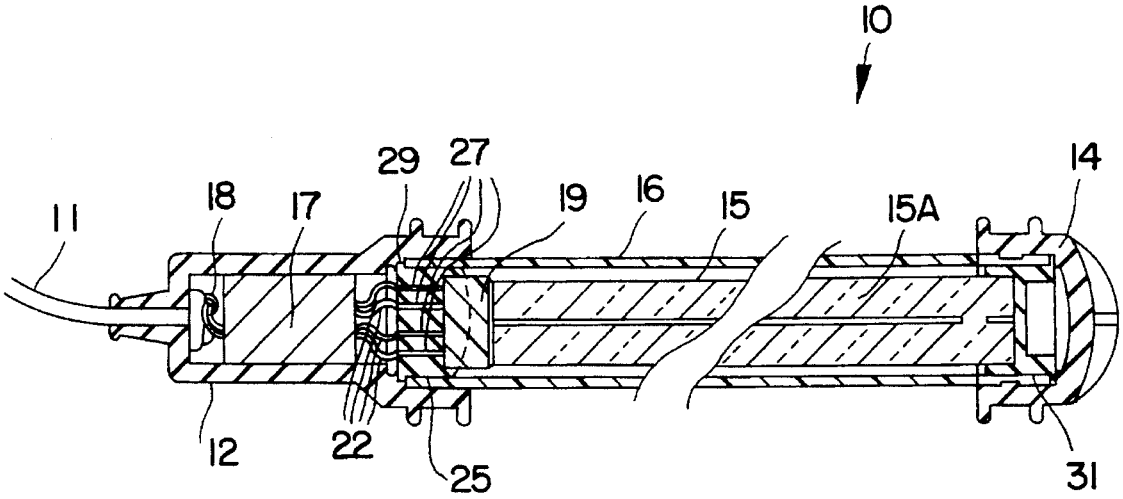
FIG. 2 is a fragmentary, cross-sectional view of the work light taken substantially along the length of the work light.

As shown in FIGS. 1 and 2, the work light 10 includes a power supply cord 11, and a shock-absorbing handle 12 and end cap 14. A phosphor-coated, fluorescent bulb 15 and protective bulb shield 16 are positioned between the handle 12 and end cap 14. The bulb shield 16, handle 12, and end cap 14 protect the fluorescent bulb 15 from breaking during use, and when the work light 10 is dropped. Preferably, the handle 12 and end cap 14 are formed of a durable rubber, such as neoprene.

The bulb shield 16 is constructed of a transparent, high-impact plastic. According to one embodiment of the work light 10, the bulb shield 16 includes an exterior disposable guard (not shown) for protecting the bulb shield 16 from scratching and scuffing, and for maintaining full and efficient light transmission of the bulb shield 16. The scuff guard product is fully described in the Applicant's U.S. Pat. No. 4,945,461.

An electronic ballast 17 is contained within the handle 12 of the work light 10, and acts to provide start-up voltage for the fluorescent bulb 15 and to limit the electric current through the various circuit elements of the work light 10. The ballast 15 is preferably encapsulated in a moisture-proof, non-conductive cylindrical housing which is removably positioned within the handle 12 of the work light 10. A defective or inoperative ballast 17 can therefore be easily and safely removed from the handle 12 for replacement. In an alternative embodiment, the ballast 17 is permanently encapsulated directly within the handle 12.

As shown in FIG. 2, the ballast 17 includes a first set of electric wires 18 connected to the power supply cord 11 for receiving an incoming electric current from a power source, such as a standard electrical outlet. Preferably, the ballast 17 is an instant-start circuit which receives and transforms 120 V AC from the outlet to approximately 277 V AC. This increased voltage provides the necessary starting voltage for activating the fluorescent bulb 15. Preferably, the ballast 17 includes a built-in frequency converter for increasing the standard 60 Hz frequency of the AC circuit to approximately 42,000 Hz.

In an alternative embodiment of the work light 10, the ballast 17 may be a preheat or rapid-start circuit. In yet another embodiment, the ballast 17 is a magnetic ballast.

Figure 3:
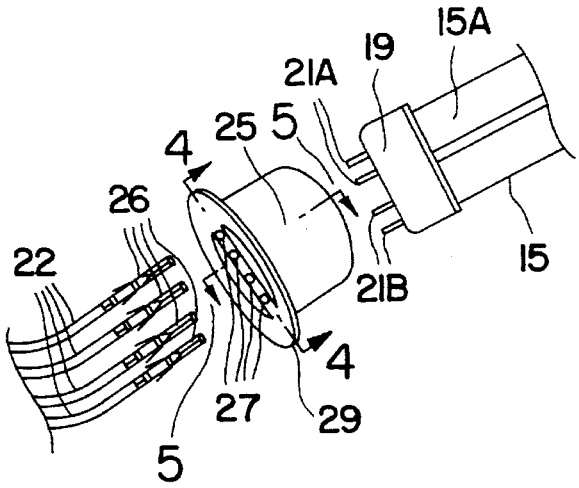
FIG. 3 is a fragmentary perspective view of the ballast wires and bulb, showing the wire connectors and external pins of the bulb disconnected from the socket.
Figure 4:
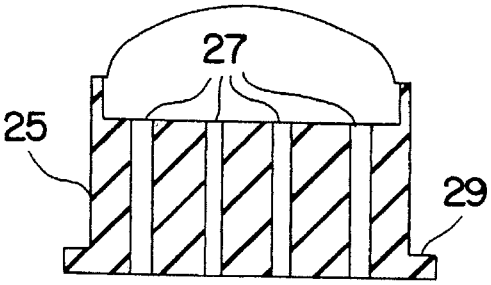
FIG. 4 is a cross-sectional view of the socket taken substantially along lines 4—4 of FIG. 3.
Figure 5:
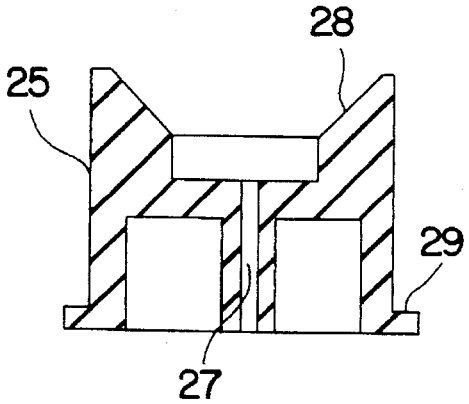
FIG. 5 is a cross-sectional view of the socket taken substantially along lines 5—5 of FIG. 3.
Figure 6:
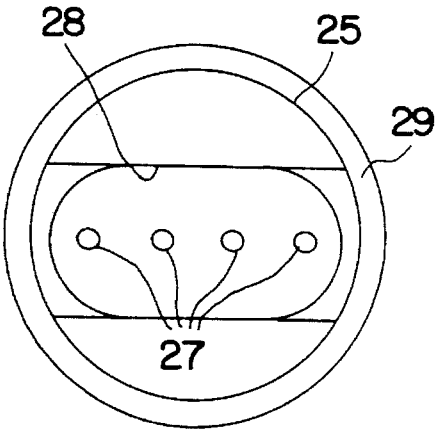
FIG. 6 is a plan view of the socket as viewed from the pin-receiving end of the socket.

As best shown in FIG. 3, the fluorescent bulb 15 includes a pin base 19 located at a proximal end of the bulb 15, and U-shaped bulb tube 15A extending outwardly from the pin base 19. Preferably, the fluorescent bulb 15 is either a 13, 18, 24, or 36 watt bulb. These bulbs have incandescent equivalents of 60, 75, 100, and 200 watts, respectively. The color rendering index (CRI) of the fluorescent bulb 15 is preferably 85/100 with a color temperature of approximately 4100° K.

First and second electrodes (not shown) are contained in the bulb 15 at the proximal end of the bulb 15. Each electrode includes a pair of external pins 21A and 21B extending outwardly from the pin base 19 for engaging a second set of electric wires 22 connected to the ballast 17. The wires 22 serve to transfer the increased electric current from the ballast 17 to the electrodes to activate the electrodes, and thereby generate ultraviolet radiation within the U-shaped bulb tube 15A. The radiation cooperates with the phosphors of the bulb 15 to produce visible light.

Referring to FIGS. 3–6, a shock-absorbing bulb socket 25 is located between the second set of ballast wires 22 and the electrode pins 21A and 21B for interconnecting the respective pins 21A, 21B and wires 22, and for providing further impact resistance to protect the bulb 15 from breakage if and when the work light 10 is dropped or damaged. As shown in FIG. 3, a barbed connector 26 is located at the free end of each of the wires 22 for being inserted at a bottom side of the socket 25 into respective openings 27 formed in the socket 25.

The external pins 21A and 21B of the fluorescent bulb 15 are inserted at the top side of the socket 25 into the openings 27 to mate the corresponding pins 21A,21B and connectors 26 together. Preferably, the top side of the socket 25 defines a guide recess 28 for directing the external pins 21A,21B of the bulb 15 into the openings 27 of the socket 25.

The bottom side of the socket 25 includes an annular flange 29 for being located adjacent to the annular bottom peripheral edge of the bulb shield 16. The annular flange 29 increases the impact resistance of the work light 10 to further protect the bulb 15 from breakage. Preferably, the socket 25 including the annular flange 29 are integrally formed of an injection molded or extruded, medium hardness thermoplastic elastomer, such as PVC nitrile.

Figure 7:
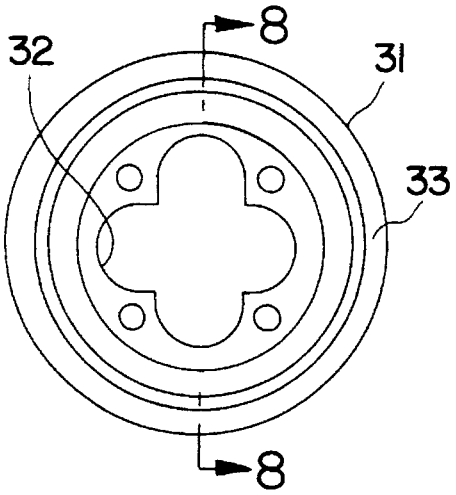
FIG. 7 is a plan view of the shock-absorbing plug as viewed from the bulb-receiving end of the plug.
Figure 8:
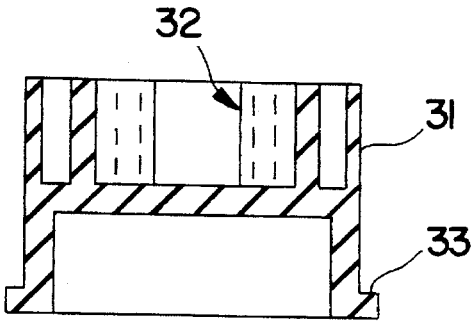
FIG. 8 is a cross-sectional view of the plug taken substantially along lines 8—8 of FIG. 7.
Figure 9:
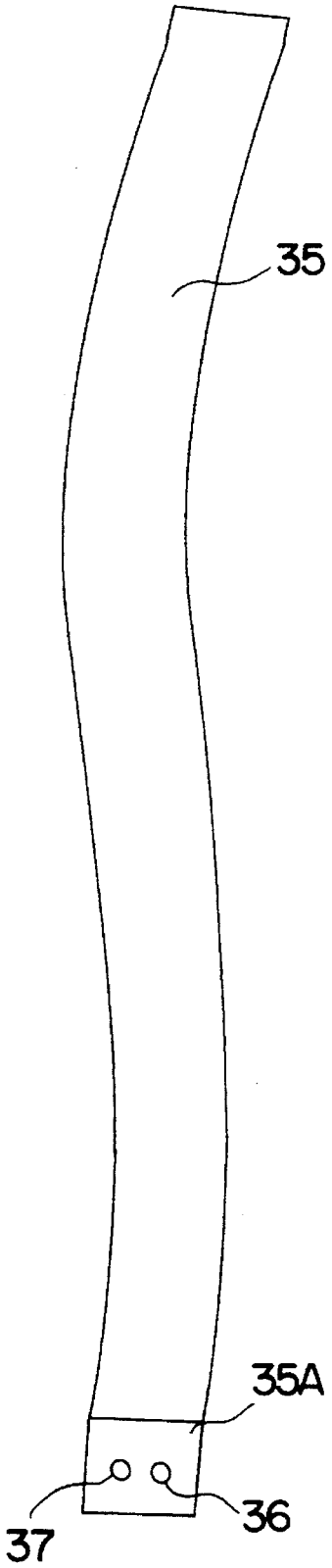
FIG. 9 is a perspective view of the pull strip according to one preferred embodiment.
Figure 10:
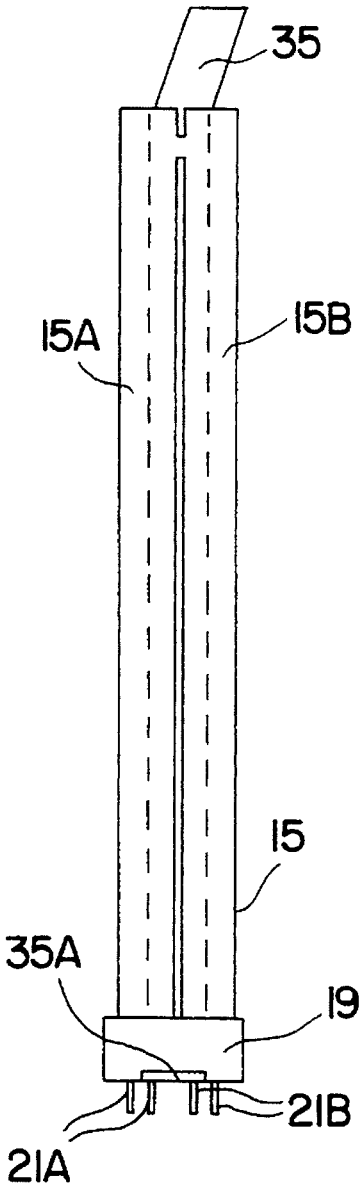
FIG. 10 is a front elevation of the bulb with attached pull strip, showing a portion of the pull strip in phantom.
Figure 11:
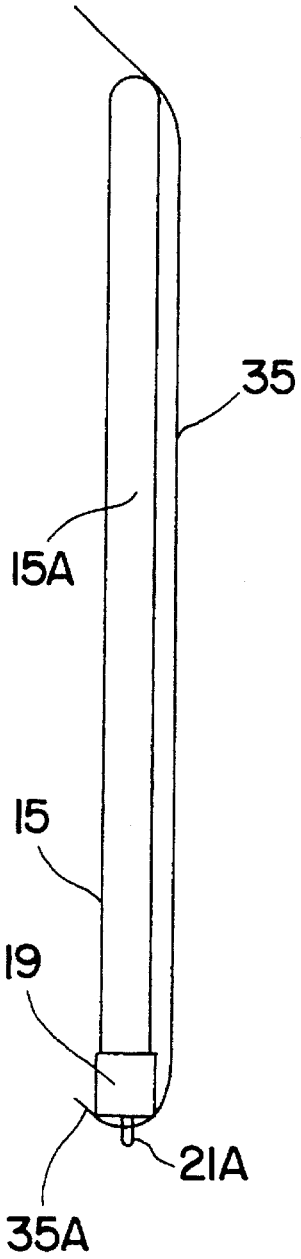
FIG. 11 is a side elevation of the bulb with attached pull strip.
Figure 12:
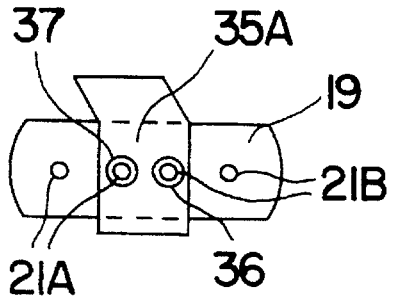
FIG. 12 is an end view of the bulb showing the releasable attachment of the pull strip to the external pins of the bulb.

As best shown in FIGS. 2, 7, and 8, the work light 10 further includes a shock-absorbing plug 31 located at the second end of the bulb shield 16 opposite the bulb socket 25. The plug 31 engages the free end of the bulb 15, and increases the impact resistance of the work light 10 for protecting the bulb 15 from damage. As shown in FIGS. 7 and 8, the plug 31 has a first surface which defines a contoured opening 32 for receiving the free end of the bulb 15 therein. The opposite surface of the plug 31 is preferably recessed, and includes an annular flange 33 for engaging the annular top peripheral edge of the bulb shield 16. The recessed area and flange 33 serve to further increase the impact resistance of the work light 10 for protecting the bulb 10. Preferably, the plug 31 including the annular flange 33 are integrally formed of an injection molded or extruded, medium hardness thermoplastic elastomer, such as PVC nitrile.

Referring to FIGS. 9–13, the work light 10 includes a non-conductive, removable pull strip 35 for use in re-lamping the work light 10. Preferably, one end of the pull strip 35 has a reinforced portion 35A with pin holes 36 and 37 formed therein for receiving the external pins 21A and 21B of the bulb 15.

When attached to the bulb 15, the pull strip 35 extends from the external pins 21A, 21B along the length of the bulb 15 and slightly beyond the second end of the bulb shield 16 for access to the user. Once the bulb is removed from the light 10, the pull strip 35 is easily detached from the bulb 15 by releasing the reinforced portion 35A from the pins 21A, 21B.

Figure 13:
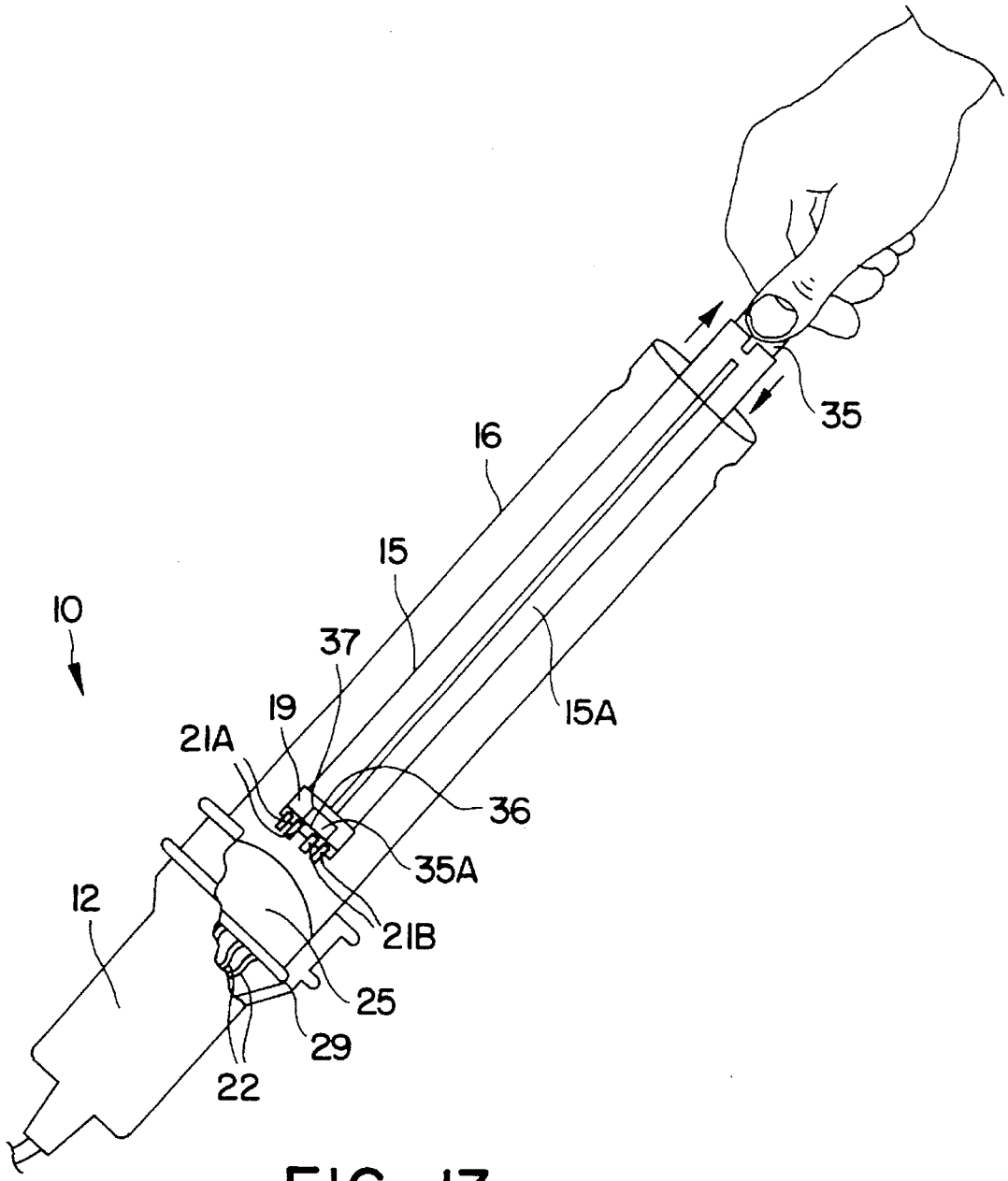
FIG. 13 is a perspective view of the light illustrating the process for re-lamping the light, and showing portions of the light broken away.

To re-lamp the work light 10, the user first removes the end cap 14 and plug 31 to expose the second end of the pull strip 35. The user then grips the pull strip 35 and gently pulls outwardly to remove the bulb 15 from the socket 25, as shown in FIG. 13. The bulb 15 is then completely removed from the bulb shield 16. The pull strip 35 is detached from the old bulb 15 and reattached to the electrode pins 21A,21B of the new bulb 15.

The new bulb 15 is then inserted into the bulb shield 16 in a similar manner to which the old bulb 15 was removed. The thumb of the user engages the free end of the bulb 15 and pushes the bulb 15 inwardly towards the socket 25. The electrode pins 21A, 21B of the bulb 15 are guided into the openings 27 of the socket 25 by the socket guide recess 28. After the new bulb 15 has been properly inserted in the socket 25, the plug 31 and end cap 14 are replaced on the second end of the bulb shield 16, and the re-lamped light 10 is ready for use.

A second embodiment of the work light 50 is illustrated in FIGS. 14–18. Like elements described above are indicated in prime notation.

The work light 50 includes a shock-absorbing socket 55, as shown in FIGS. 15–18. As described above, the socket 55 includes a plurality of longitudinal openings 57 for receiving on one side thereof the connectors 26' of the ballast 17' and on the other side thereof, the external pins 21A',21B' of the bulb 15'. A guide recess 58 formed in the socket 55 directs the pins 21A',21B' of the bulb 15' into the respective openings 57 to be mated with the connectors 26' during re-lamping. A recessed area 59 opposite the guide recess 58 provides additional space for receiving the ballast 17', thus permitting the overall length of the work light 50 to be shortened. For example, the work light 50 may be between 10 to 12 inches in length.

The socket 55 further includes an annular flange 61 for being located adjacent to the annular bottom peripheral edge of the bulb shield 16'. The annular flange 61 increases the impact resistance of the work light 50 to protect the bulb 15' from breakage. Preferably, the socket 55 including the annular flange 61 are constructed as described above with reference to the socket 25.

Figure 14:
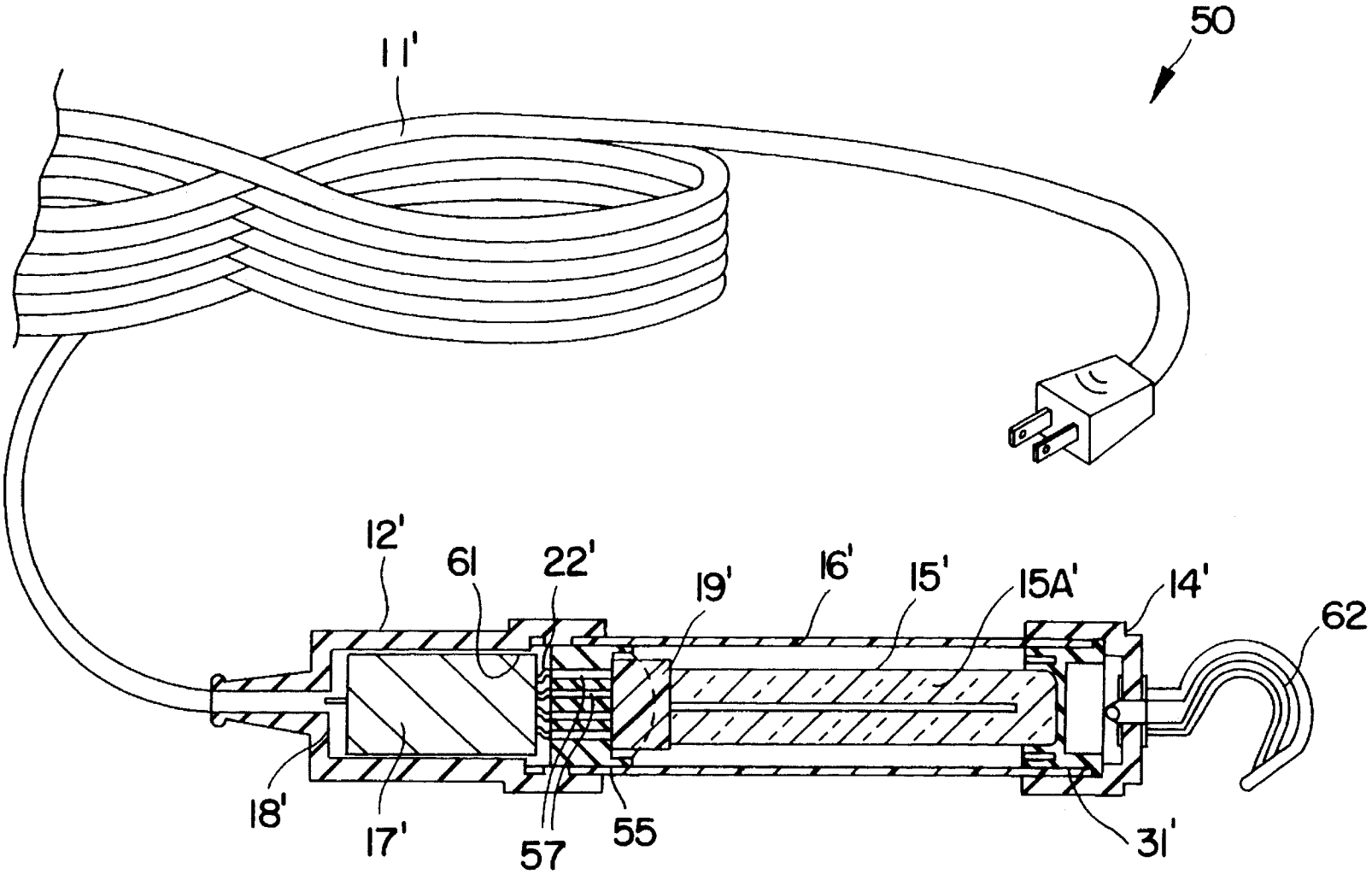
FIG. 14 is a fragmentary perspective view of the work light according to a second preferred embodiment of the invention.
Figure 15:
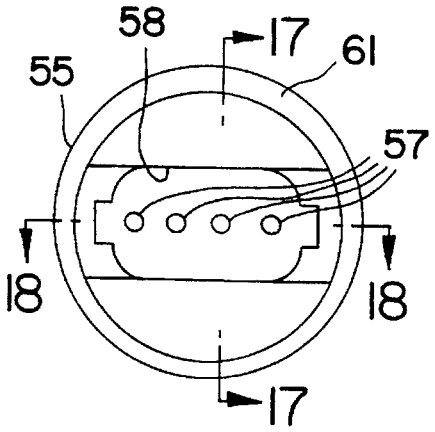
FIG. 15 is a plan view of the socket, according to a second preferred embodiment, as view from the pin-receiving end of the socket.
Figure 16:
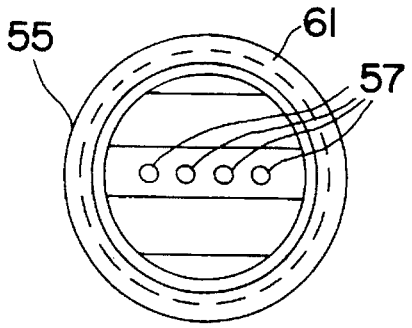
FIG. 16 is a plan view of the socket, according to a second preferred embodiment, as view from the wire-receiving end of the socket.
Figure 17:
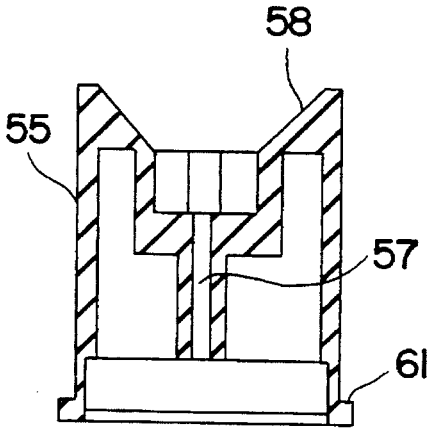
FIG. 17 is a cross-sectional view of the socket taken substantially along lines 17—17 of FIG. 15.
Figure 18:
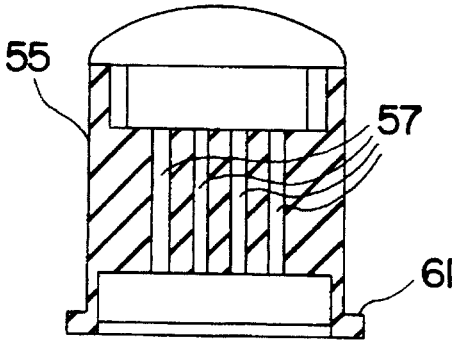
FIG. 18 is a cross-sectional view of the socket taken substantially along lines 18—18 of FIG. 15.

As shown in FIG. 14, the work light 50 further includes a hanger hook 62 for suspending the work light 50 from an overhanging pipe or similar structure. The hook 62 is preferably constructed of a polymer material. The work light 50 may include two hooks attached, respectively, to the handle 12' and the end cap 14' of the light 50 for permitting horizontal hanging.

Figure 19:
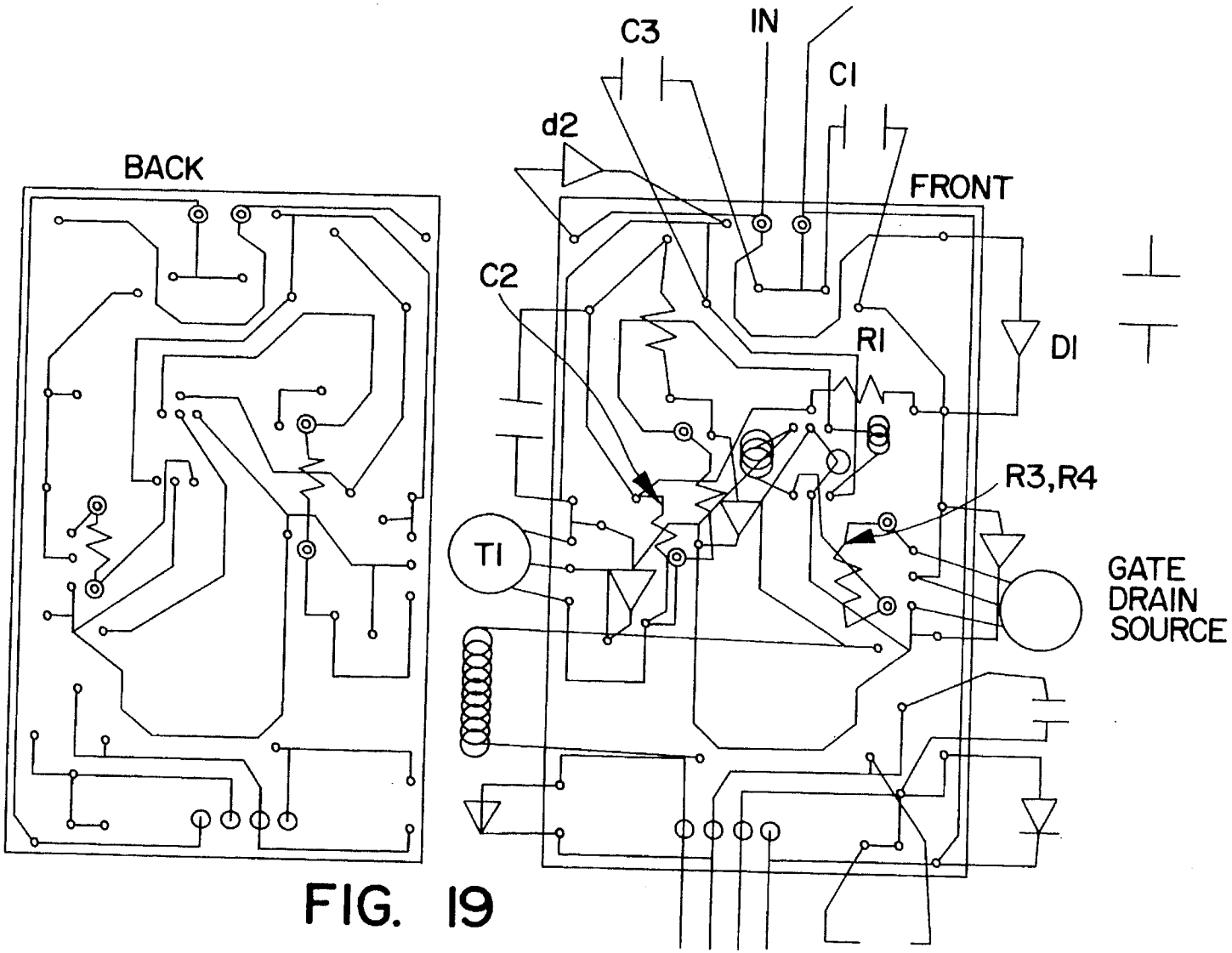
FIG. 19 is a schematic diagram of the electronic circuitry of the ballast according to a preferred embodiment of the invention.

FIG. 19 is a front and back schematic diagram of the electronic circuitry of the ballast 17, 17' for each of the embodiments of-the work light 10, 50 described above. As shown, the circuit includes a plurality of capacitors (C1, C2, and C3) and resistors (R1, R2, R3, and R4).

The handle 12, end cap 13, bulb 15, bulb shield 16, socket 25, and plug 31 according to the embodiments of the work light 10 and 50 described above are readily detached and separated from each other for replacement as necessary, and to permit convenient access to the electronic ballast 17. All surface elements of the work light 10,50 are preferably non-conductive. The term non-conductive is defined as having sufficient dielectric to be considered non-conductive at voltages below 600 V AC.

A hand-held fluorescent work light is described above. Various details of the invention may be changed without departing from its scope. Furthermore, the foregoing description of the preferred embodiment of the invention is provided for the purpose of illustration only and not for the purpose of limitation—the invention being defined by the claims.

I claim:

1. In combination with a portable light assembly including a ballast, a bulb having at least one electrode operatively connected to the ballast, and an elongate light-transmitting protective shield surrounding the bulb, the improvement comprising a resilient shock-absorbing bulb socket located adjacent to a connecting, proximal end of the bulb to protect the bulb against impact damage, said bulb socket comprising:

(a) a top and bottom, and integrally formed side walls engaging an inside wall of the protective shield;

(b) a plurality of openings extending longitudinally through the socket from the top to the bottom thereof for receiving through the bottom a plurality of electrical wires connected to the ballast, and for receiving through the top a corresponding number of outwardly-extending external pins connected to the electrode of the bulb; and (c) said top defining an inwardly tapered guide recess for guiding the electrode pins of said bulb into the respective openings of the socket for engagement with the electrical wires of the ballast.

2. A combination according to claim 1, wherein said bulb socket includes an annular flange located adjacent to an annular peripheral edge of a proximal end of said bulb shield for providing shock absorption to protect the bulb from impact damage.

3. A combination according to claim 2, wherein said annular flange is integrally formed with said bulb socket.

4. A combination according to claim 1, wherein said bulb socket is constructed of a thermoplastic elastomer.

5. A combination according to claim 4, wherein said thermoplastic elastomer comprises PVC nitrile.

6. A resilient shock-absorbing bulb socket for use in a portable light assembly including a ballast, a bulb having at least one electrode operatively connected to the ballast, and an elongate light-transmitting protective shield surrounding the bulb, said bulb socket adapted for being located adjacent to a connecting, proximal end of the bulb to protect the bulb against impact damage, said bulb socket comprising:

(a) a top and bottom, and integrally formed side walls for engaging an inside wall of the protective shield;

(b) plurality of openings extending longitudinally through the socket from the top to the bottom thereof for receiving through the bottom a plurality of electrical wires connected to the ballast, and for receiving through the top a corresponding number of outwardly-extending external pins connected to the electrode of the bulb: and (c) said top defining an inwardly tapered guide recess for guiding the electrode spins of said bulb into the respective openings of the socket for engagement with the electrical wires of the ballast.

7. A sock-absorbing bulb socket according to claim 6, and including an annular flange for being located adjacent to an annular peripheral edge of a proximal end of said bulb shield for providing shock absorption to protect the bulb from impact damage.

8. A sock-absorbing bulb socket according to claim 7, wherein said annular flange is integrally formed with said bulb socket.

9. A sock-absorbing bulb socket according to claim 6, wherein said bulb socket is constructed of a thermoplastic elastomer.

10. A sock-absorbing bulb socket according to claim 9, wherein said thermoplastic elastomer comprises PVC nitrile.

* * * * *